US011607776B2

(12) United States Patent
Lukowski et al.

(10) Patent No.: US 11,607,776 B2
(45) Date of Patent: Mar. 21, 2023

(54) SHAPED VITRIFIED ABRASIVE AGGLOMERATE, ABRASIVE ARTICLES, AND METHOD OF ABRADING

(71) Applicant: 3M INNOVATIVE PROPERTIES COMPANY, St. Paul, MN (US)

(72) Inventors: Mark A. Lukowski, St. Paul, MN (US); Brian D. Goers, Minneapolis, MN (US); Negus B. Adefris, St. Paul, MN (US); Scott W. Peterson, Highlands Ranch, CO (US)

(73) Assignee: 3M Innovative Properties Company, St. Paul, MN (US)

( * ) Notice: Subject to any disclaimer, the term of this patent is extended or adjusted under 35 U.S.C. 154(b) by 1003 days.

(21) Appl. No.: 16/318,655

(22) PCT Filed: Jul. 19, 2017

(86) PCT No.: PCT/US2017/042825
§ 371 (c)(1),
(2) Date: Jan. 17, 2019

(87) PCT Pub. No.: WO2018/017695
PCT Pub. Date: Jan. 25, 2018

(65) Prior Publication Data

US 2019/0283216 A1 Sep. 19, 2019

Related U.S. Application Data

(60) Provisional application No. 62/364,495, filed on Jul. 20, 2016.

(51) Int. Cl.
*B24D 3/34* (2006.01)
*B24D 3/32* (2006.01)
(Continued)

(52) U.S. Cl.
CPC ..... *B24D 3/346* (2013.01); *B24D 3/002* (2013.01); *B24D 3/18* (2013.01); *B24D 3/28* (2013.01);
(Continued)

(58) Field of Classification Search
CPC ..... B24D 3/346; B24D 3/022; B24D 3/18; B24D 3/28; B24D 3/32
See application file for complete search history.

(56) References Cited

U.S. PATENT DOCUMENTS 2,958,593 A 11/1960 Hoover
4,314,827 A 2/1982 Leitheiser
(Continued)

FOREIGN PATENT DOCUMENTS

WO WO 1993-012911 7/1993
WO WO 2015-088953 6/2015

OTHER PUBLICATIONS

International Search Report from International Application No. PCT/US2017/042825, dated Oct. 18, 2017, 4 pages.

*Primary Examiner* — Pegah Parvini
(74) *Attorney, Agent, or Firm* — Kathleen B. Gross

(57) ABSTRACT

An abrasive agglomerate particle includes fused aluminum oxide mineral bonded in a vitreous matrix. The fused aluminum oxide mineral is present in a range from 70 percent by weight to 95 percent by weight and the vitreous matrix is present at least at five percent by weight, based on the weight of the abrasive agglomerate particle. The fused aluminum oxide mineral has an average particle size of up to 300 micrometers, and the abrasive agglomerate particle has a frusto-pyramidal shape with side walls having a taper angle in a range from 2 to 15 degrees and a dimension of at least 400 micrometers. The abrasive agglomerate particles are useful in abrasive articles. The method includes contacting the workpiece with an abrasive article and moving the
(Continued)

workpiece and the abrasive article relative to each other to abrade the workpiece.

20 Claims, 1 Drawing Sheet

(51) Int. Cl.
*B24D 3/00* (2006.01)
*B24D 3/28* (2006.01)
*B24D 3/18* (2006.01)
*B24D 11/00* (2006.01)

(52) U.S. Cl.
CPC ..... *B24D 3/32* (2013.01); *B24D 11/00* (2013.01); *B24D 11/001* (2013.01)

(56) References Cited

U.S. PATENT DOCUMENTS 4,518,397 A 5/1985 Leitheiser
4,623,364 A 11/1986 Cottringer
4,652,274 A 3/1987 Boettcher
4,652,275 A * 3/1987 Bloecher ..... C09K 3/1436 51/307
4,744,802 A 5/1988 Schwabel
4,751,138 A 6/1988 Tumey
4,770,671 A 9/1988 Monroe
4,799,939 A * 1/1989 Bloecher ..... B24D 11/001 51/296
4,881,951 A 11/1989 Wood
4,903,440 A 2/1990 Larson
4,960,441 A 10/1990 Pellow
4,985,340 A 1/1991 Palazzotto
5,011,513 A 4/1991 Zador
5,086,086 A 2/1992 Brown-Wensley
5,139,978 A 8/1992 Wood
5,164,348 A 11/1992 Wood
5,201,916 A 4/1993 Berg
5,213,591 A 5/1993 Celikkaya
5,236,472 A 8/1993 Kirk
5,366,523 A 11/1994 Rowenhorst
5,376,428 A 12/1994 Palazzotto
5,385,954 A 1/1995 Palazzotto
5,427,595 A 6/1995 Pihl
5,429,647 A 7/1995 Larmie
5,443,906 A 8/1995 Pihl
5,498,269 A 3/1996 Larmie
5,547,479 A 8/1996 Conwell
5,551,959 A 9/1996 Martin
5,551,963 A 9/1996 Larmie
5,591,239 A 1/1997 Larson
RE35,570 E 7/1997 Rowenhorst
5,651,801 A 7/1997 Monroe
5,679,067 A 10/1997 Johnson
5,725,162 A 3/1998 Garg
5,903,951 A 5/1999 Ionta
5,975,988 A 11/1999 Christianson
5,984,988 A 11/1999 Berg
6,017,831 A 1/2000 Beardsley
6,054,093 A 4/2000 Torre, Jr.
6,217,413 B1 4/2001 Christianson
6,277,161 B1 8/2001 Castro
6,319,108 B1 11/2001 Adefris
6,354,929 B1 3/2002 Adefris
6,645,624 B2 11/2003 Adefris
6,702,650 B2 3/2004 Adefris
6,722,952 B2 4/2004 Goers
6,817,935 B2 11/2004 Bates
6,951,504 B2 10/2005 Adefris
7,344,574 B2 3/2008 Thurber
7,887,608 B2 2/2011 Schwabel
8,034,137 B2 10/2011 Erickson
8,123,828 B2 2/2012 Culler
8,142,531 B2 3/2012 Adefris
8,142,532 B2 3/2012 Erickson
8,142,891 B2 3/2012 Culler
8,251,774 B2 8/2012 Joseph
8,764,865 B2 7/2014 Boden
10,058,970 B2 8/2018 Gagliardi
10,350,732 B2 7/2019 Lukowski
2002/0160694 A1 10/2002 Wood
2003/0176156 A1* 9/2003 Braunschweig ..... B24D 3/28 451/526
2003/0181144 A1* 9/2003 Mujumdar ..... B24B 7/241 451/41
2003/0213182 A1 11/2003 Knapp
2006/0041065 A1 2/2006 Barber, Jr.
2010/0319269 A1 12/2010 Erickson
2011/0183142 A1 7/2011 Gebhardt
2014/0080393 A1 3/2014 Ludwig
2015/0052824 A1 2/2015 Gebhardt
2015/0052825 A1 2/2015 Adefris
2015/0267097 A1 9/2015 Rosenflanz
2019/0185636 A1 6/2019 Goers
2020/0047313 A1 2/2020 Lukowski
2021/0002533 A1 1/2021 Skorina

* cited by examiner

SHAPED VITRIFIED ABRASIVE AGGLOMERATE, ABRASIVE ARTICLES, AND METHOD OF ABRADING

CROSS-REFERENCE TO RELATED APPLICATION

This application is a national stage filing under 35 U.S.C. 371 of PCT/US2017/042825, filed Jul. 19, 2017, which claims priority to U.S. Provisional Application No. 62/364,495, filed Jul. 20, 2016, the disclosure of which is incorporated by reference in its entirety herein.

BACKGROUND

Shaped abrasive agglomerates including diamond abrasive particles in a ceramic matrix have been disclosed in U.S. Pat. No. 5,975,988 (Christianson), U.S. Pat. Nos. 6,319,108, 6,702,650, and 6,951,504 (each to Adefris) and in Int. Pat. Appl. Pub. No. WO2015/088953 (Kasai).

SUMMARY

An inconsistent cut-rate over the life of an abrasive tool is a problem encountered when abrading a workpiece. Shaped agglomerates according to the present disclosure can be useful for providing abrasive articles that can exhibit unexpected extended life and stable cut-rates over that extended life when compared to state-of-the art monolayer constructions. Advantageously, the shaped agglomerates according to the present disclosure need not contain superabrasive grains and can be useful for abrading a variety of workpieces, including those having a Rockwell C hardness of 20 or less.

In one aspect, the present disclosure provides an abrasive agglomerate particle that includes fused aluminum oxide mineral bonded in a vitreous matrix. The fused aluminum oxide mineral is present in a range from 70 percent by weight to 95 percent by weight and the vitreous matrix is present at least at five percent by weight, based on the weight of the abrasive agglomerate particle. The fused aluminum oxide mineral has an average particle size of up to 300 micrometers, and the abrasive agglomerate particle has a frusto-pyramidal shape with side walls having a taper angle in a range from 2 to 15 degrees and a dimension of at least 400 micrometers.

In another aspect, the present disclosure provides an abrasive article including a plurality of the abrasive agglomerate particles.

In another aspect, the present disclosure provides a method of abrading a workpiece. The method includes contacting the workpiece with an abrasive article including a plurality of the abrasive agglomerate particles and moving the workpiece and the abrasive article relative to each other to abrade the workpiece.

In another aspect, the present disclosure provides a method of abrading a workpiece. The method includes contacting a workpiece with an abrasive article and moving the workpiece and the abrasive article relative to each other to abrade the workpiece. The workpiece has a Rockwell C hardness of 20 or less. The abrasive article includes a backing and a plurality of shaped abrasive agglomerate particles attached to the backing with a polymeric binder having a Knoop hardness of less than 60. The shaped abrasive agglomerate particles include abrasive particles having a Knoop hardness of up to 3000 bonded in a vitreous matrix.

In this application, terms such as "a", "an" and "the" are not intended to refer to only a singular entity, but include the general class of which a specific example may be used for illustration. The terms "a", "an", and "the" are used interchangeably with the term "at least one". The phrases "at least one of" and "comprises at least one of" followed by a list refers to any one of the items in the list and any combination of two or more items in the list. All numerical ranges are inclusive of their endpoints and integral and non-integral values between the endpoints unless otherwise stated (e.g. 1 to 5 includes 1, 1.5, 2, 2.75, 3, 3.80, 4, and 5). The term "ceramic" as used herein refers to glasses, crystalline ceramics, glass-ceramics, and combinations thereof. The term "vitreous matrix" as used herein refers to a glassy matrix. A glassy matrix may contain some crystalline domains (e.g., in a glass-ceramic).

The above summary of the present disclosure is not intended to describe each disclosed embodiment or every implementation of the present disclosure. The description that follows more particularly exemplifies illustrative embodiments. It is to be understood, therefore, that the following description should not be read in a manner that would unduly limit the scope of this disclosure.

Figure 1:
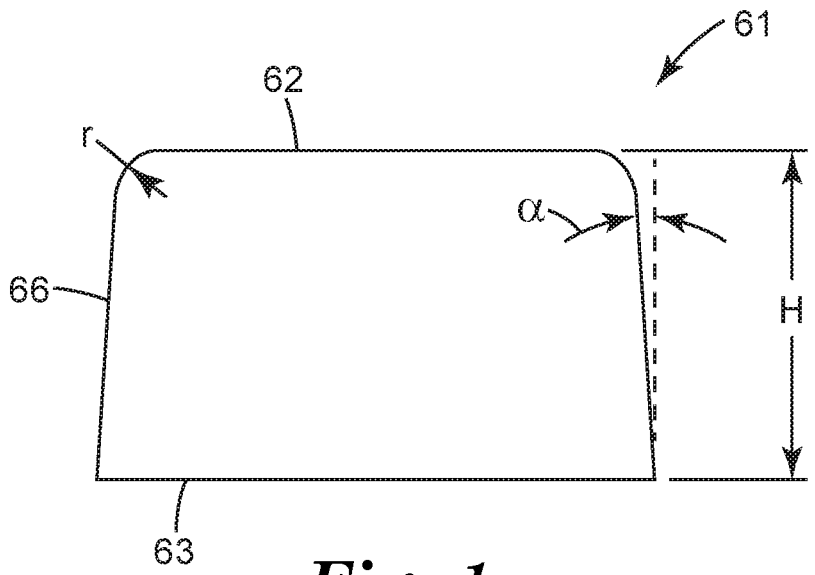
FIG. 1 is a partial cross-sectional view of an embodiment of an abrasive agglomerate according to the present disclosure.

While the above-identified drawings and figures set forth embodiments of this disclosure, other embodiments are also contemplated, as noted in the Detailed Description. In all cases, this disclosure presents the invention by way of representation and not limitation. It should be understood that numerous other modifications and embodiments can be devised by those skilled in the art, which fall within the scope of this disclosure. The figures may not be drawn to scale.

DETAILED DESCRIPTION

Consistent material removal rates over the life of an abrasive tool are desirable for many abrasive processes. However, the useful lifespan of an abrasive tool can be limited by a required break-in time at the beginning of use and/or higher requisite forces to achieve specific material removal rates after significant wear, possibly causing out-of-specification finishes or workpiece burn.

To achieve a consistent material removal rate, a particular hardness, chemical property, and breakdown/fracture behavior of an abrasive mineral can be targeted by influencing the microstructure and secondary phases within the grain. However, this approach does not always lead to a desirable consistency in material removal rate.

Grinding results for Examples 1 to 5 in the Examples, below, demonstrate that coated abrasive articles including shaped agglomerates according to the present disclosure can exhibit unexpected extended life and stable cut-rates over that life when compared to state-of-the art monolayer constructions. The stable cut rates are achieved with the agglomerate particles according to the present disclosure, which contain traditional fused alumina particles, instead of harder, more expensive superabrasive grains.

Shaped agglomerates according to the present disclosure include fused alumina Fused alumina abrasive particles are typically made by charging a furnace with an alumina source (such as aluminum ore or bauxite), as well as other desired additives, heating the material above its melting point, cooling the melt to provide a solidified mass, crushing the solidified mass into particles, and then screening and grading the particles to provide the desired abrasive particle size distribution.

Fused aluminum oxide (alumina) particles useful in the agglomerates according to the present disclosure have an average particle size up to 300 micrometers, in some embodiments, up to 200 micrometers, or up to 100 micrometers. Useful fused alumina particles can have an average particle size in a range from about one micrometer to 300 micrometers, one micrometer to 200 micrometers, one micrometer to 100 micrometers, ten micrometers to 100 micrometers, 15 micrometers to 100 micrometers, or greater than 25 micrometers to 100 micrometers. The desired alumina particle size may be selected, for example, to provide a desired cut rate and/or desired surface roughness on a workpiece. Occasionally, abrasive particle sizes are reported as "mesh" or "grade", both of which are commonly known abrasive particle sizing methods. In some embodiments, the fused alumina particles have a FEPA (Federation of European Producers of Abrasives) grade of at least P50. For example, FEPA P50, FEPA P60, FEPA P80, FEPA P100, FEPA P120, FEPA P150, FEPA P180, FEPA P220, FEPA P320, FEPA P400, FEPA P500, FEPA P600, FEPA P800, FEPA P1000, and FEPA P1200 grades may be useful.

Fused alumina is commercially available in a variety of abrasives industry-recognized specified nominal grades from several commercial sources, for example, Washington Mills Electro Minerals Company, Niagara Falls, N.Y., and Treibacher Schleifmittel GmbH, Villach, Austria.

Shaped abrasive agglomerate particles useful in the method according to the present disclosure can comprise abrasive particles having a Knoop hardness of up to 3000. Such particles include fused alumina particles, which have a Knoop hardness of about 2000. Other particles having a Knoop hardness of up to 3000 include silicon carbide and sol-gel derived abrasive grain (e.g., that obtained from 3M Company, St. Paul, Minn. under the trade designation "CUBITRON 321"). A person skilled in the art would understand that a Knoop hardness of 3000 is approximately equivalent to a Vickers hardness of about 30 GPa.

Shaped agglomerate particles according to the present disclosure include a vitreous matrix. The vitreous matrix can be a glass or a glass-ceramic. Various types of glass and glass-ceramics may be useful to make the vitreous matrix. A vitreous matrix suitable for aluminum oxide abrasive wheels, for example, would be suitable. The glass frit used in the examples, below, provides such a vitreous matrix.

The vitreous matrix may be produced from a precursor composition comprising a mixture or combination of one or more raw materials that when heated to a high temperature melt and/or fuse to form an integral vitreous matrix phase. The vitreous matrix may be formed, for example, from a frit. A frit is a composition that has been pre-fired before its employment in a vitreous bond precursor composition for forming the vitreous matrix of the abrasive agglomerate particle. As used herein, the term "frit" is a generic term for a material that is formed by thoroughly blending a mixture comprising one or more frit forming components, followed by heating (also referred to as pre-firing) the mixture to a temperature at least high enough to melt it; cooling the resulting glass, and crushing it. The crushed material can then be screened to a very fine powder.

Examples of suitable glasses for the vitreous matrix and the frit for making it include silica glass, silicate glass, borosilicate glass, and combinations thereof. A silica glass is typically composed of 100 percent by weight of silica. In some embodiments, the vitreous matrix is a glass that include metal oxides or oxides of metalloids, for example, aluminum oxide, silicon oxide, boron oxide, magnesium oxide, sodium oxide, manganese oxide, zinc oxide, calcium oxide, barium oxide, lithium oxide, potassium oxide, titanium oxide, metal oxides that can be characterized as pigments (e.g., cobalt oxide, chromium oxide, and iron oxide), and mixtures thereof.

Examples of suitable ranges for the vitreous matrix, vitreous matrix precursor compositions, and/or frit include 25 to 90% be weight, optionally 35 to 85% by weight, based on the total weight of the vitreous material, of $SiO_2$; 0 to 40% by weight, optionally 0 to 30% by weight, based on the total weight of the vitreous material, of $B_2O_3$; 0 to 40% by weight, optionally 5 to 30% by weight, based on the total weight of the vitreous material, of $Al_2O_3$; 0 to 5% by weight, optionally 0 to 3% by weight, based on the total weight of the vitreous material, of $Fe_2O_3$; 0 to 5% by weight, optionally 0 to 3% by weight, based on the total weight of the vitreous material, of $TiO_2$; 0 to 20% by weight, optionally 0 to 10% by weight, based on the total weight of the vitreous material, of CaO; 0 to 20% by weight, optionally 1 to 10% by weight, based on the total weight of the vitreous material, of MgO; 0 to 20% by weight, optionally 0 to 10% by weight, based on the total weight of the vitreous material, of $K_2O$; 0 to 25% by weight, optionally 0 to 15% by weight, based on the total weight of the vitreous material, of $Na_2O$; 0 to 20% by weight, optionally 0 to 12% by weight, based on the total weight of the vitreous material, of $Li_2O$; 0 to 10% by weight, optionally 0 to 3% by weight, based on the total weight of the vitreous material, of ZnO; 0 to 10% by weight, optionally 0 to 3% by weight, based on the total weight of the vitreous material, of BaO; and 0 to 5% by weight, optionally 0 to 3% by weight, based on the total weight of the vitreous material, of metallic oxides (e.g., CoO, $Cr_2O_3$ or other pigments).

An example of a suitable silicate glass composition comprises about 70 to about 80 percent by weight of silica, about 10 to about 20 percent sodium oxide, about 5 to about 10 percent calcium oxide, about 0.5 to about 1 percent aluminum oxide, about 2 to about 5 percent magnesium oxide, and about 0.5 to about 1 percent potassium oxide, based on the total weight of the glass frit. Another example of a suitable silicate glass composition includes about 73 percent by weight of silica, about 16 percent by weight of sodium oxide, about 5 percent by weight of calcium oxide, about 1 percent by weight of aluminum oxide, about 4 percent by weight of magnesium oxide, and about 1 percent by weight of potassium oxide, based on the total weight of the glass frit. In some embodiments, the glass matrix comprises an alumina-borosilicate glass comprising $SiO_2$, $B_2O_3$, and $Al_2O_3$. An example of a suitable borosilicate glass composition comprises about 50 to about 80 percent by weight of silica, about 10 to about 30 percent by weight of boron oxide, about 1 to about 2 percent by weight of aluminum oxide, about 0 to about 10 percent by weight of magnesium oxide, about 0 to about 3 percent by weight of zinc oxide, about 0 to about 2 percent by weight of calcium oxide, about 1 to about 5 percent by weight of sodium oxide, about 0 to about 2 percent by weight of potassium oxide, and about 0 to about 2 percent by weight of lithium oxide, based on the total weight of the glass frit. Another example of a suitable borosilicate glass composition includes about 52 percent by weight of silica, about 27 percent by weight of boron oxide, about 9 percent by weight of aluminum oxide, about 8 percent by weight of magnesium oxide, about 2 percent by weight of zinc oxide, about 1 percent by weight of calcium oxide, about 1 percent by weight of sodium oxide, about 1 percent by weight of potassium oxide, and about 1 percent by weight of lithium oxide, based on the total weight of the glass frit. Other examples suitable borosilicate glass composition include, based upon weight, 47.61% $SiO_2$, 16.65% $Al_2O_3$, 0.38% $Fe_2O_3$, 0.35% $TiO_2$, 1.58% CaO, 0.10% MgO, 9.63% $Na_2O$, 2.86% $K_2O$, 1.77% $Li_2O$, 19.03% $B_2O_3$, 0.02% $MnO_2$, and 0.22% $P_2O_5$; and 63% $SiO_2$, 12% $Al_2O_3$, 1.2% CaO, 6.3% $Na_2O$, 7.5% $K_2O$, and 10% $B_2O_3$. In some embodiments, a useful alumina-borosilicate glass composition comprises, by weight, about 18% $B_2O_3$, 8.5% $Al_2O_3$, 2.8% BaO, 1.1% CaO, 2.1% $Na_2O$, 1.0% $Li_2O$, with the balance being $Si_2O$. Such an alumina-borosilicate glass is commercially available from Specialty Glass Incorporated, Oldsmar, Fla.

Glass frit for making glass-ceramics may be selected from the group consisting of magnesium aluminosilicate, lithium aluminosilicate, zinc aluminosilicate, calcium aluminosilicate, and combinations thereof. Known crystalline ceramic phases that can form glasses within the above listed systems include: cordierite ($2MgO.2Al_2O_3.5SiO_2$), gehlenite ($2CaO.Al_2O_3.SiO_2$), anorthite ($2CaO.Al_2O_3.2SiO_2$), hardystonite ($2CaO.ZnO.2SiO_2$), akeranite ($2CaO.MgO.2SiO_2$), spodumene ($2Li_2O.Al_2O_3.4SiO_2$), willemite ($2ZnO.SiO_2$), and gahnite ($ZnO.Al_2O_3$). Glass frit for making glass-ceramic may comprise nucleating agents. Nucleating agents are known to facilitate the formation of crystalline ceramic phases in glass-ceramics. As a result of specific processing techniques, glassy materials do not have the long range order that crystalline ceramics have. Glass-ceramics are the result of controlled heat-treatment to produce, in some cases, over 90% crystalline phase or phases with the remaining non-crystalline phase filling the grain boundaries. Glass ceramics combine the advantage of both ceramics and glasses and offer durable mechanical and physical properties.

Frit useful for forming the vitreous matrix may also contain frit binders (e.g, feldspar, borax, quartz, soda ash, zinc oxide, whiting, antimony trioxide, titanium dioxide, sodium silicofluoride, flint, cryolite, boric acid, and combinations thereof) and other minerals (e.g., clay, kaolin, wollastonite, limestone, dolomite, chalk, and combinations thereof).

The vitreous matrix in the agglomerate particles according to the present disclosure may be selected, for example, based on a desired coefficient of thermal expansion (CTE). Generally, it is useful for the vitreous matrix and the fused alumina particles to have similar CTEs, for example, ±100%, 50%, 40%, 25%, or 20% of each other. The CTE of fused alumina is typically about $8\times10^{-6}$/Kelvin (K). A vitreous matrix may be selected to have a CTE in a range from $4\times10^{-6}$/K to $16\times10^{-6}$/K. The glass frit used in the examples, below, is believed to have a CTE of about $7.7\times10^{-6}$/K. An example of a glass frit for making a suitable vitreous matrix is commercially available, for example, from, Fusion Ceramics, Carrollton, Ohio, under the trade designation "F245".

The agglomerate particles comprise about 70 percent to 95 percent by weight alumina particles and 30 percent to 5 percent by weight vitreous matrix, based on the total weight of the agglomerate particles. In some embodiments, the agglomerate particles comprise about 70 percent to 85 percent by weight alumina particles and 30 percent to 15 percent by weight vitreous matrix, based on the total weight of the agglomerate particles. In some embodiments, the agglomerate particles comprise about 70 percent to 80 percent by weight alumina particles and 30 percent to 20 percent by weight vitreous matrix, based on the total weight of the agglomerate particles. In the agglomerate particles according to the present disclosure, the amount of vitreous matrix is relatively small (e.g., up to 30, 20, 15, or 5 percent), which can be useful to facilitate the desired erosion of the agglomerate particle, for example, in a coated belt used in centerless grinding applications.

The agglomerate particles may further contain other additives such as fillers, grinding aids, pigments (e.g., metal oxide pigments), adhesion promoters, and other processing materials. Examples of fillers include small glass bubbles, solid glass spheres, alumina, zirconia, titania, and metal oxide fillers, which can improve the erodibility of the agglomerates. Examples of grinding aids include waxes, organic halide compounds, halide salts, and metals and their alloys. The organic halide compounds will typically break down during abrading and release a halogen acid or a gaseous halide compound. Examples of such materials include chlorinated waxes like tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, and magnesium chloride. Examples of metals include tin, lead, bismuth, cobalt, antimony, cadmium, iron, and titanium. Examples of other grinding aids include sulfur, organic sulfur compounds, graphite, and metallic sulfides. A combination of different grinding aids can be used. Examples of pigments include iron oxide, titanium dioxide, and carbon black. Examples of processing materials, i.e., processing aids, include liquids and temporary organic binder precursors. The liquids can be water, an organic solvent, or combinations thereof. Examples of organic solvents include alkanes, alcohols such as isopropanol, ketones such as methylethyl ketone, esters, and ethers.

The shape of the agglomerate particle according to the present disclosure is frusto-pyramidal, which may also be referred to as a truncated pyramid. In some embodiments, the agglomerate particle has the shape of a square frustrum. FIG. 1 illustrates agglomerate particle 61 having a base 63, top surface 62, and side wall 66. The angle between the dashed line and the side wall 66 defines the taper angle $\alpha$ of agglomerate particle 61. In some embodiments, the taper angle $\alpha$ of agglomerate particle 61 is less than 20 degrees. In some embodiments, the taper angle $\alpha$ of agglomerate particle 61 is in a range from 2 degrees to 15 degrees. In some embodiments, the taper angle $\alpha$ of agglomerate particle 61 is 8 degrees. A taper angle $\alpha$ of less than 20 degrees, in some embodiments, from 2 to 15 degrees or 8 degrees is believed to lead to the uniform wear of the agglomerate particle 61 that is evidenced by the consistent cut, cycle after cycle, shown in Examples 1 through 5, below. A taper greater than zero degrees also aids in removal of the agglomerate particle from the tooling used for molding the agglomerate particle. Also shown in FIG. 1 is radius r, which is the internal radius of the corner where side wall 66 meets top surface 62. It may be useful to have a slightly rounded or radiused corner to thoroughly fill the mold with material and remove agglomerate particle from the mold. Height H of the agglomerate particle 61 is measured from the base 61 to top surface 62.

Agglomerate particles according to the present disclosure have a face dimension of at least 400 micrometers, in some embodiments, at least 500 micrometers, or at least 600 micrometers. The face dimension can be a width, length, or diagonal of one of the six faces of the frusto-pyramid. The maximum face dimension of the agglomerate particle would typically be the diagonal of the base 63 shown in FIG. 1. In some embodiments, agglomerate particles according to the present disclosure have a maximum face dimension of up to 1.5 millimeters (mm), less than 1.5 mm, up to 1.4 mm, 1.25 mm, 1 mm, or 0.9 mm. In some embodiments, the agglomerate particles have a face dimension in a range from about 400 micrometer to 1.5 mm, 400 micrometers to 1000 micrometers, 500 micrometers to 1000 micrometers, 500 micrometers to 900 micrometers, or 600 micrometers to 900 micrometers. Generally, the face dimension (in some embodiments, the maximum face dimension) of the agglomerate particles is at least about 3, 5, or 10 times the average size of the fused alumina in the agglomerate particles.

Shaped agglomerate particles useful in the method according to the present disclosure may have other shapes and sizes. Examples of useful shapes of the shaped agglomerate particles include a triangle, circle, rectangle, square, inverse pyramidal, frusto-pyramidal, truncated spherical, truncated spheroidal, conical, and frusto-conical.

A variety of methods may be useful for making the agglomerate particles according to the present disclosure, for example, molding, extrusion, and die cutting. One method for making the agglomerate particles comprises, for example, mixing starting materials comprising a vitreous matrix precursor (e.g., glass frit), fused alumina, and a temporary organic binder. The temporary organic binder permits the mixture to be more easily shaped and to retain this shape during further processing. Examples of suitable temporary organic binders include dextrin and methylcellulose. Optionally, other additives and processing aids, as described above, e.g., inorganic fillers, grinding aids, and/or a liquid medium (e.g., water or organic solvent) may be used. The starting materials can be mixed together by any conventional technique which results in a uniform mixture. For example, the fused alumina grains can be mixed with a temporary organic binder in a mechanical mixing device such as a planetary mixer. The vitreous matrix precursor (e.g., glass frit) can then be added to the resulting mixture and blended until a uniform mixture is achieved, typically 10 to 30 minutes.

In some embodiments, the starting materials are mixed in a liquid medium (e.g., water or organic solvent) to make a slurry. Some inorganic fillers such as fumed silica fillers can be useful, for example, as rheology modifiers.

The mixture can then be shaped and processed to form agglomerate precursors. The mixture may be shaped, for example, by molding, extrusion, and die cutting. There will typically be some shrinkage associated with the loss of the temporary organic binder, and this shrinkage may be taken into account when determining the initial shape and size. The shaping process can be done on a batch process or in a continuous manner. In some embodiments, shaping the agglomerate is carried out by placing the starting materials, which have been combined and formed into a uniform mixture, into a mold having the inverse shape of the frusto-pyramid of the agglomerate particles. The mold can be any mold which allows for release of the particles, for example, a silicone mold or a polypropylene mold. Additionally, the mold may contain a release agent to aid in the removal. The mold, containing the mixture, can then be placed in an oven and heated to least partially remove any liquid. The temperature depends on the temporary organic binder used and is typically between 35 to 200° C., in some embodiments, 70 to 150° C. The at least partially dried mixture is then removed from the mold. It is also possible to destroy (e.g., completely burn off) the mold to release the agglomerates.

The agglomerate precursors are then heated to burn off the organic materials used to prepare the agglomerate precursors, for example, the temporary organic binder, and to melt or vitrify the vitreous binder, which may occur separately or as one continuous step, accommodating any necessary temperature changes. The temperature to burn off the organic materials may be selected to control the porosity in the agglomerate particles. The selected temperature can depend on the chemistry of the temporary organic binder and other optional ingredients. Typically, the temperature for burning off organic materials ranges from about 50 to 600° C., in some embodiments, from 75 to 500° C., although higher temperatures are also possible. The temperature for melting or vitrifying the vitreous binder typically ranges between 650 to 1150° C., in some embodiments, between 650 to 950° C.

The agglomerate particles may contain a coating of inorganic particles which may be useful for minimizing the aggregation of the agglomerate particles with one another during their manufacture. However, the coating is not considered part of the agglomerate particles since they are not incorporated within or bonded in the matrix. The agglomerate particles according to the present disclosure include fused alumina particles bonded in the vitreous matrix. Fused alumina within the vitreous matrix is bonded by the matrix and cannot be removed by simple rinsing or sieving.

Examples of inorganic particles suitable for coating the agglomerate particles according to the present disclosure include fillers and abrasive grains, for example, metal carbonates, silica, silicates, metal sulfates, metal carbides, metal nitrides, metal borides, gypsum, metal oxides, graphite, and metal sulfites. The inorganic particles may comprise fused alumina including fused alumina described above in any of its embodiments. The inorganic particles suitable for the coating may have the same, larger, or smaller particle size as the fused alumina particles in the agglomerate particles. In some embodiments, the inorganic particles have a size ranging from about 10 to 500, in some embodiments 25 to 250, micrometers. A coating of inorganic particles can be made by mixing the agglomerate particles after they are shaped (e.g., removed from the mold) with the inorganic particles. A small amount of at least one of water, solvent, or temporary organic binder precursor, for example, in an amount ranging from 5 to 15 weight %, or from 6 to 12 weight %, based on the weight of the agglomerate precursor, may also be added to aid in securing the inorganic particles to the surface of the agglomerate precursor.

The resulting agglomerates can then be thermally processed to optimize bond properties. The thermal processing comprises heating at a temperature ranging from 300 to 900° C., in some embodiments, 350 to 800° C. or 400 to 700° C.

The agglomerate particles may be porous or nonporous. Porosity can influence the erosion of the agglomerate during an abrading process by facilitating the release of used alumina. As described above, porosity in the agglomerates can arise from the temporary organic binder. Engineered porosity can also be generated through the use of fillers. For example, glass bubbles can be included with the glass frit to incorporate pores into the vitreous matrix. Other fillers that may be useful for forming pores include cork, crushed shells, or polymeric materials. As used herein, the term "engineered porosity" refers to porosity that is incorporated into the agglomerate particles by design through the use of fillers or other pore forming agents. Engineered porosity would not include, for example, porosity that would inherently occur during the formation of the vitreous matrix. In some embodiments, the agglomerates include about zero percent to about 60 percent pores by volume, in some cases about zero percent to about 25 percent pores by volume, as observed by Scanning Electron Microscopy.

Agglomerate particles according to the present disclosure may be useful, for example, in coated abrasives and nonwoven abrasives. Coated abrasives can comprise a plurality of the agglomerate particles bonded to a backing. Nonwoven abrasives can comprise a plurality of the agglomerate particles bonded onto and into a lofty, porous, nonwoven substrate. Bonding materials for coated and nonwoven abrasives they are typically organic binders.

Figure 2:
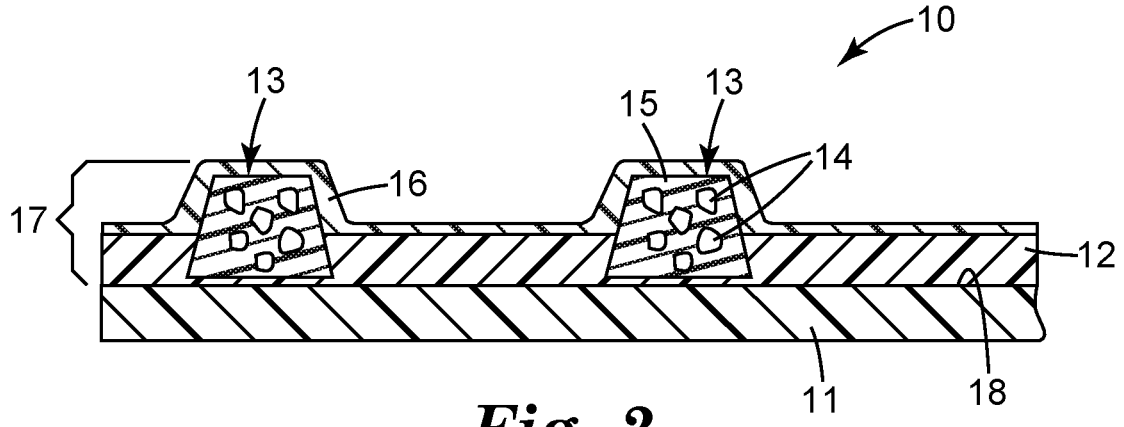
FIG. 2 is a partial cross-section view of an embodiment of an abrasive article including an abrasive agglomerate according to the present disclosure.

An embodiment of a coated abrasive including agglomerate particles according to the present disclosure is shown in FIG. 2. In the embodiment illustrated in FIG. 2, a coated abrasive article 10 comprises a backing 11 having a make coat 12 present on a first major surface 18 of the backing. A plurality of agglomerate particles 13 are adhered in the make coat. The make coat serves to bond the agglomerate particles to the backing. The agglomerate particles comprise a plurality of fused alumina grans 14 and vitreous matrix 15. The shape of the agglomerate particles 13 is frusto-pyramidal. In the illustrated embodiment, the abrasive agglomerates are in the shape of a truncated four-sided pyramid (that is, a square frustrum). Over the agglomerate particles 13 is a size coat 16. One purpose of the size coat is to reinforce adhesion of the agglomerate particles 13 on the backing 11. The make coat, the size coat, and the agglomerate particles in coated abrasive form an abrasive layer 17.

A variety of backings 11 are suitable for coated abrasive articles according to the present disclosure. Examples of suitable backings 11 include polymeric film, primed polymeric film, greige cloth, cloth, paper, vulcanized fiber, nonwovens, treated versions of these, and combinations thereof. The backing 11 may comprise optional additives, for example, fillers, fibers, antistatic agents, lubricants, wetting agents, surfactants, pigments, dyes, coupling agents, plasticizers, and suspending agents. The amounts of these optional materials depend on the properties desired. The backing may be selected such that it has sufficient strength and heat resistance to withstand its process and use conditions under abrading. Additionally, if the abrasive article is intended to be used in a wet or lubricating environment, the backing may be selected such that it has sufficient water and/or oil resistance, obtaining by treating the backing with a thermosetting resin so that it does not degrade during abrading. Useful resins include phenolic resins, which can optionally be modified with rubber; epoxy resins, which can optionally be modified with a fluorene compound; and bismaleimide resins.

In a coated abrasive, the make coat 12 and size coat 16 may collectively be referred to as a binder, and they may be made from the same or different binder precursors. During manufacture of a coated abrasive article, a binder precursor is exposed to an energy source which aids in the initiation of the polymerization or curing of the binder precursor. Examples of energy sources include thermal energy and radiation energy (e.g., electron beam, ultraviolet light, and visible light). During this polymerization process, the binder precursor is polymerized or cured and is converted into a solidified binder.

The binder can be formed of a curable (e.g., via energy such as UV light or heat) organic material. Examples include amino resins, alkylated urea-formaldehyde resins, melamine-formaldehyde resins, and alkylated benzoguanamine-formaldehyde resin, acrylate resins (including acrylates and methacrylates) such as vinyl acrylates, acrylated epoxies, acrylated urethanes, acrylated polyesters, acrylated acrylics, acrylated polyethers, vinyl ethers, acrylated oils, and acrylated silicones, alkyd resins such as urethane alkyd resins, polyester resins, reactive urethane resins, phenolic resins such as resole and novolac resins, phenolic/latex resins, epoxy resins such as bisphenol epoxy resins, isocyanates, isocyanurates, polysiloxane resins (including alkylalkoxysilane resins), reactive vinyl resins, and phenolic resins (resole and novolac). The resins may be provided as monomers, oligomers, polymers, or combinations thereof.

The binder precursor can be a condensation curable resin, an addition polymerizable resin, a free-radical curable resin, and/or combinations and blends of such resins. One binder precursor is a resin or resin mixture that polymerizes via a free-radical mechanism. The polymerization process is initiated by exposing the binder precursor, along with an appropriate catalyst, to an energy source such as thermal energy or radiation energy. Examples of radiation energy include electron beam, ultraviolet light, or visible light.

Examples of suitable binder precursors include phenolic resins, urea-formaldehyde resins, aminoplast resins, urethane resins, melamine formaldehyde resins, cyanate resins, isocyanurate resins, (meth)acrylate resins (e.g., (meth)acrylated urethanes, (meth)acrylated epoxies, ethylenically-unsaturated free-radically polymerizable compounds, aminoplast derivatives having pendant alpha, beta-unsaturated carbonyl groups, isocyanurate derivatives having at least one pendant acrylate group, and isocyanate derivatives having at least one pendant acrylate group) vinyl ethers, epoxy resins, and mixtures and combinations thereof. As used herein, the term "(meth)acryl" encompasses acryl and methacryl. Ethylenically-unsaturated monomers or oligomers, or (meth)acrylate monomers or oligomers, may be monofunctional, difunctional, trifunctional or tetrafunctional, or even higher functionality.

Phenolic resins have good thermal properties, availability, and relatively low cost and ease of handling There are two types of phenolic resins, resole and novolac. Resole phenolic resins have a molar ratio of formaldehyde to phenol of greater than or equal to one to one, typically in a range of from 1.5:1.0 to 3.0:1.0. Novolac resins have a molar ratio of formaldehyde to phenol of less than one to one. Examples of commercially available phenolic resins include those known by the trade designations DUREZ and VARCUM from Occidental Chemicals Corp., Dallas, Tex.; RESINOX from Monsanto Co., Saint Louis, Mo.; and AEROFENE and AROTAP from Ashland Specialty Chemical Co., Dublin, Ohio.

(Meth)acrylated urethanes include di(meth)acrylate esters of hydroxyl-terminated NCO extended polyesters or polyethers. Examples of commercially available acrylated urethanes include those available as CMD 6600, CMD 8400, and CMD 8805 from Cytec Industries, West Paterson, N.J.

(Meth)acrylated epoxies include di(meth)acrylate esters of epoxy resins such as the diacrylate esters of bisphenol A epoxy resin. Examples of commercially available acrylated epoxies include those available as CMD 3500, CMD 3600, and CMD 3700 from Cytec Industries.

Ethylenically-unsaturated free-radically polymerizable compounds include both monomeric and polymeric compounds that contain atoms of carbon, hydrogen, and oxygen, and optionally, nitrogen and the halogens. Oxygen or nitrogen atoms or both are generally present in ether, ester, urethane, amide, and urea groups. Ethylenically-unsaturated free-radically polymerizable compounds typically have a molecular weight of less than about 4,000 g/mole and are typically esters made from the reaction of compounds containing a single aliphatic hydroxyl group or multiple aliphatic hydroxyl groups and unsaturated carboxylic acids, such as acrylic acid, methacrylic acid, itaconic acid, crotonic acid, isocrotonic acid, maleic acid, and the like. Representative examples of (meth)acrylate resins include methyl methacrylate, ethyl methacrylate styrene, divinylbenzene, vinyl toluene, ethylene glycol diacrylate, ethylene glycol methacrylate, hexanediol diacrylate, triethylene glycol diacrylate, trimethylolpropane triacrylate, glycerol triacrylate, pentaerythritol triacrylate, pentaerythritol methacrylate, pentaerythritol tetraacrylate and pentaerythritol tetraacrylate. Other ethylenically-unsaturated resins include monoallyl, polyallyl, and polymethallyl esters and amides of carboxylic acids, such as diallyl phthalate, diallyl adipate, and N,N-diallyladipamide. Still other ethylenically-unsaturated compounds are nitrogen-containing compounds such as tris (2-acryloyl-oxyethyl) isocyanurate, 1,3,5-tris(2-methyacryloxyethyl)-s-triazine, acrylamide, N-methylacrylamide, N,N-dimethylacrylamide, N-vinylpyrrolidone, and N-vinylpiperidone.

Useful aminoplast resins have at least one pendant alpha, beta-unsaturated carbonyl group per molecule or oligomer. These unsaturated carbonyl groups can be acrylate, methacrylate, or acrylamide type groups. Examples of such materials include N-(hydroxymethyl)acrylamide, N,N'-oxydimethylenebisacrylamide, ortho- and para-acrylamidomethylated phenol, acrylamidomethylated phenolic novolac, and combinations thereof. These materials are further described in U.S. Pat. Nos. 4,903,440 and 5,236,472 (both to Kirk et al.).

Isocyanurate derivatives having at least one pendant acrylate group. Isocyanate derivatives having at least one pendant acrylate group are further described in U.S. Pat. No. 4,652,274 (Boettcher et al.). An example of one isocyanurate material is the triacrylate of tris(hydroxyethyl) isocyanurate.

Epoxy resins have one or more epoxy groups that may be polymerized by ring opening of the epoxy group(s). Such epoxy resins include monomeric epoxy resins and oligomeric epoxy resins. Examples of useful epoxy resins include 2,2-bis[4-(2,3-epoxypropoxy)-phenyl propane] (diglycidyl ether of bisphenol) and materials available as EPON 828, EPON 1004, and EPON 1001F from Momentive Specialty Chemicals, Columbus, Ohio; and DER-331, DER-332, and DER-334 from Dow Chemical Co., Midland, Mich. Other suitable epoxy resins include glycidyl ethers of phenol formaldehyde novolac commercially available as DEN-431 and DEN-428 from Dow Chemical Co.

The epoxy resins can polymerize via a cationic mechanism with the addition of an appropriate cationic curing agent. Cationic curing agents generate an acid source to initiate the polymerization of an epoxy resin. These cationic curing agents can include a salt having an onium cation and a halogen containing a complex anion of a metal or metalloid. Other curing agents (e.g., amine hardeners and guanidines) for epoxy resins and phenolic resins may also be used.

Other cationic curing agents include a salt having an organometallic complex cation and a halogen containing complex anion of a metal or metalloid which are further described in U.S. Pat. No. 4,751,138 (Tumey et al.). Other examples include an organometallic salt and an onium salt as described in U.S. Pat. No. 4,985,340 (Palazzotto et al.); U.S. Pat. No. 5,086,086 (Brown-Wensley et al.); and U.S. Pat. No. 5,376,428 (Palazzotto et al.). Still other cationic curing agents include an ionic salt of an organometallic complex in which the metal is selected from the elements of Periodic Group IVB, VB, VIB, VIIB and VIIIB which is described in U.S. Pat. No. 5,385,954 (Palazzotto et al.).

Free-radically polymerizable ethylenically-unsaturated compounds polymerize on exposure to free-radicals formed by decomposition of free-radical thermal initiators and/or photoinitiators, or by exposure to particulate (electron beam) or high energy radiation (gamma rays). Compounds that generate a free-radical source if exposed to actinic electromagnetic radiation (e.g., ultraviolet or visible electromagnetic radiation) are generally termed photoinitiators.

Examples of free-radical thermal initiators include peroxides, e.g., benzoyl peroxide and azo compounds.

Examples of photoinitiators include benzoin and its derivatives such as alpha-methylbenzoin; alpha-phenylbenzoin; alpha-allylbenzoin; alpha-benzylbenzoin; benzoin ethers such as benzil dimethyl ketal (e.g., as commercially available as IRGACURE 651 from Ciba Specialty Chemicals, Tarrytown, N.Y.), benzoin methyl ether, benzoin ethyl ether, benzoin n-butyl ether; acetophenone and its derivatives such as 2-hydroxy-2-methyl-1-phenyl-1-propanone (e.g., as DAROCUR 1173 from Ciba Specialty Chemicals) and 1-hydroxycyclohexyl phenyl ketone (e.g., as IRGACURE 184 from Ciba Specialty Chemicals); 2-methyl-1-[4-(methylthio)phenyl]-2-(4-morpholinyl)-1-propanone (e.g., as IRGACURE 907 from Ciba Specialty Chemicals; 2-benzyl-2-(dimethylamino)-1-[4-(4-morpholinyl)phenyl]-1-butanone (e.g., as IRGACURE 369 from Ciba Specialty Chemicals). Other useful photoinitiators include, for example, pivaloin ethyl ether, anisoin ethyl ether, anthraquinones (e.g., anthraquinone, 2-ethylanthraquinone, 1-chloroanthraquinone, 1,4-dimethylanthraquinone, 1-methoxyanthraquinone, or benzanthraquinone), halomethyltriazines, benzophenone and its derivatives, iodonium salts and sulfonium salts, titanium complexes such as bis (eta.sub.5-2,4-cyclopentadien-1-yl)-bis[2,6-difluoro-3-(1H-pyrrol-1-yl)phenyl]titanium (e.g., as CGI 784DC from Ciba Specialty Chemicals); halonitrobenzenes (e.g., 4-bromomethylnitrobenzene), mono- and bis-acylphosphines (e.g., as IRGACURE 1700, IRGACURE 1800, IRGACURE 1850, DAROCUR 4263, and DAROCUR 4265 all from Ciba Specialty Chemicals, and 2,4,6-trimethylbenzoyl-diphenylphosphine oxide available as LUCIRIN TPO from BASF Corporation, Charlotte, N.C.). Combinations of photoinitiators may be used.

Typically, the curative (e.g., free-radical initiator (photo or thermal) or cationic cure catalyst) is used in amounts ranging from 0.1 to 10 percent, preferably 2 to 4 percent by weight, based on the weight of the binder material precursor, although other amounts may also be used. Additionally, it is preferred to uniformly disperse or dissolve the initiator in the binder matrix precursor prior to the addition of any particulate material, such as the abrasive particles and/or filler particles. One or more spectral sensitizers (e.g., dyes) may be used in conjunction with the photoinitiator(s), for example, in order to increase sensitivity of the photoinitiator to a specific source of actinic radiation. Examples of suitable sensitizers include thioxanthone and 9,10-anthraquinone. In general, the amount of photosensitizer may vary from about 0.01 to 10 percent by weight, more preferably from 0.25 to 4.0 percent by weight, based on the weight of the binder material precursor. Examples of photosensitizers include those available as QUANTICURE ITX, QUANTICURE QTX, QUANTICURE PTX, QUANTICURE EPD from Biddle Sawyer Corp., New York, N.Y.

To promote an association bridge between the binder and the agglomerate particles, a silane coupling agent may be included in the slurry of abrasive particles and binder precursor; typically in an amount of from about 0.01 to 5 percent by weight, more typically in an amount of from about 0.01 to 3 percent by weight, more typically in an amount of from about 0.01 to 1 percent by weight, although other amounts may also be used, for example depending on the size of the abrasive particles. Suitable silane coupling agents include, for example, methacryloxypropyltrimethoxysilane, vinyltriethoxysilane, vinyltris(2-methoxyethoxy)silane, 3,4-epoxycyclohexylmethyltrimethoxysilane, gamma-glycidoxypropyltrimethoxysilane, and gamma-mercaptopropyltrimethoxysilane (e.g., as available under the respective trade designations A-174, A-151, A-172, A-186, A-187, and A-189 from Witco Corp. of Greenwich, Conn.), allyltriethoxysilane, diallyldichlorosilane, divinyldiethoxysilane, and meta, para-styrylethyltrimethoxysilane (e.g., as commercially available under the respective trade designations A0564, D4050, D6205, and S 1588 from United Chemical Industries, Bristol, Pa.), dimethyldiethoxysilane, dihydroxydiphenylsilane, triethoxysilane, trimethoxysilane, triethoxysilanol, 3-(2-aminoethylamino) propyltrimethoxysilane, methyltrimethoxysilane, vinyltriacetoxysilane, methyltriethoxysilane, tetraethyl orthosilicate, tetramethyl orthosilicate, ethyltriethoxysilane, amyltriethoxysilane, ethyltrichlorosilane, amyltrichlorosilane, phenyltrichlorosilane, phenyltriethoxysilane, methyltrichlorosilane, methyldichlorosilane, dimethyldichlorosilane, dimethyldiethoxysilane, and combinations thereof.

The binder and/or binder precursor may optionally contain additives such as, for example, colorants, grinding aids, fillers, viscosity modifying agents, wetting agents, dispersing agents, light stabilizers, and antioxidants.

Fillers useful in the binder generally have an average particle size range of 0.1 to 50 micrometers, typically 1 to 30 micrometers. Examples of useful fillers include metal carbonates (e.g., calcium carbonate such as chalk, calcite, marl, travertine, marble, and limestone; calcium magnesium carbonate; sodium carbonate; and magnesium carbonate), silica (e.g., quartz, glass beads, glass bubbles, and glass fibers), silicates (e.g., talc, clays such as montmorillonite, feldspar, mica, calcium silicate, calcium metasilicate, sodium aluminosilicate, sodium silicate, lithium silicate, and hydrous and anhydrous potassium silicate), metal sulfates (e.g., calcium sulfate, barium sulfate, sodium sulfate, aluminum sodium sulfate, aluminum sulfate), gypsum, vermiculite, wood flour, aluminum trihydrate, carbon black, metal oxides (e.g., calcium oxide such as lime, aluminum oxide, tin oxide such as stannic oxide, titanium dioxide), sulfites (e.g., calcium sulfite), thermoplastic particles (e.g., polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (e.g., phenolic bubbles, phenolic beads, polyurethane foam particles). The filler may also be a salt such as a halide salt. Examples of halide salts include sodium chloride, potassium cryolite, sodium cryolite, ammonium chloride, potassium tetrafluoroborate, sodium tetrafluoroborate, silicon fluorides, potassium chloride, and magnesium chloride. Examples of metal fillers include, tin, lead, bismuth, cobalt, antimony, cadmium, iron, and titanium. Other miscellaneous fillers include sulfur, organic sulfur compounds, graphite, and metallic sulfides.

In some embodiments, the polymeric binder has a Knoop hardness of less than 60. The Knoop hardness of the polymeric binder can be influenced, for example, by selection of a filler and coupling agent. In some embodiments, the polymeric binder includes less than 50 percent by weight of any of the fillers described above, based on the total weight of the polymeric binder composition. In some embodiments, the polymeric binder does not include filler or includes less than 5, 4, 3, 2, or 1 percent by weight of any of the fillers described above, based on the total weight of the polymeric binder composition. Knoop hardness numbers for polymeric binders not containing filler generally range from 20 to 50. Knoop hardness can be measured using ASTM D 1474-85 (Method A), in view of the details provided in the Examples, below. In some embodiments, the polymeric binder does not include a silane coupling agent or includes less than 0.5, 0.2, or 0.1 percent by weight of a silane coupling agent, based on the total weight of the polymeric binder composition.

A variety of methods may be suitable for making a coated abrasive article according to the present disclosure. Referring again to FIG. 2, make coat 12 comprising a first organic-based binder precursor can be applied to the first major surface 18 of the backing 11 by any suitable technique such as spray coating, roll coating, die coating, powder coating, hot melt coating or knife coating. Agglomerate particles 13, which can be prepared as described above, can be projected on and adhered in the make coat precursor. In some embodiments, the agglomerate particles are drop coated. In some embodiments, the agglomerate particles 13 form a monolayer on the backing 11.

The resulting construction is then exposed to a first energy source, such as heat or radiation as described above, to at least partially cure the first binder precursor to form a make coat that does not flow. For example, the resulting construction can be exposed to heat at a temperature between 50 to 130° C., in some embodiments 80 to 110° C., for a period of time ranging from 30 minutes to 3 hours. Following this, a size coat comprising a second binder precursor, which may be the same or different from the first binder precursor, is applied over the agglomerate particles by any conventional technique, for example, by spray coating, roll coating, and curtain coating. Finally, the resulting abrasive article is exposed to a second energy source, which may be the same or different from the first energy source, to completely cure or polymerize the make coat and the second binder precursor into thermosetting polymers.

Nonwoven abrasives according to the present disclosure include nonwoven webs suitable for use in abrasives. The term "nonwoven" refers to a material having a structure of individual fibers or threads that are interlaid but not in an identifiable manner such as in a knitted fabric. The partial cross-section view shown in FIG. 2 can also illustrate an embodiment of nonwoven abrasive article according to the present disclosure, wherein reference number 11 refers to an individual fiber of the nonwoven abrasive article. Typically, the nonwoven web comprises an entangled web of fibers. The fibers may comprise continuous fiber, staple fiber, or a combination thereof. For example, the nonwoven web may comprise staple fibers having a length of at least about 20 mm, at least about 30 mm, or at least about 40 mm, and less than about 110 mm, less than about 85 mm, or less than about 65 mm, although shorter and longer fibers (e.g., continuous filaments) may also be useful. The fibers may have a fineness or linear density of at least about 1.7 decitex (dtex, i.e., grams/10000 meters), at least about 6 dtex, or at least about 17 dtex, and less than about 560 dtex, less than about 280 dtex, or less than about 120 dtex, although fibers having lesser and/or greater linear densities may also be useful. Mixtures of fibers with differing linear densities may be useful, for example, to provide an abrasive article that upon use will result in a specifically preferred surface finish. If a spunbond nonwoven is used, the filaments may be of substantially larger diameter, for example, up to 2 mm or more in diameter.

The nonwoven web may be manufactured, for example, by conventional air laid, carded, stitch bonded, spun bonded, wet laid, and/or melt blown procedures. Air laid nonwoven webs may be prepared using equipment such as, for example, that available under the trade designation "RANDO WEBBER" commercially available from Rando Machine Company of Macedon, N.Y.

Nonwoven webs are typically selected to be suitably compatible with adhering binders and abrasive particles while also being processable in combination with other components of the article, and typically can withstand processing conditions (e.g., temperatures) such as those employed during application and curing of the curable composition. The fibers may be chosen to affect properties of the abrasive article such as, for example, flexibility, elasticity, durability or longevity, abrasiveness, and finishing properties. Examples of fibers that may be suitable include natural fibers, synthetic fibers, and mixtures of natural and/or synthetic fibers. Examples of synthetic fibers include those made from polyester (e.g., polyethylene terephthalate), nylon (e.g., hexamethylene adipamide, polycaprolactam), polypropylene, acrylonitrile (i.e., acrylic), rayon, cellulose acetate, polyvinylidene chloride-vinyl chloride copolymers, and vinyl chloride-acrylonitrile copolymers. Examples of suitable natural fibers include cotton, wool, jute, and hemp. The fiber may be of virgin material or of recycled or waste material, for example, reclaimed from garment cuttings, carpet manufacturing, fiber manufacturing, or textile processing. The fiber may be homogenous or a composite such as a bicomponent fiber (e.g., a co-spun sheath-core fiber). The fibers may be tensilized and crimped but may also be continuous filaments such as those formed by an extrusion process. Combinations of fibers may also be used.

Binders useful for bonding the agglomerate particles according to the present disclosure onto and into the nonwoven web can include any of those described above. Before impregnation with the binder precursor, the nonwoven fiber web typically has a weight per unit area (i.e., basis weight) of at least about 50 grams per square meter (gsm), at least about 100 gsm, or at least about 200 gsm; and/or less than about 400 gsm, less than about 350 gsm, or less than about 300 gsm, as measured prior to any coating (e.g., with the curable composition or optional pre-bond resin), although greater and lesser basis weights may also be used. In addition, before impregnation with the binder precursor, the fiber web typically has a thickness of at least about 5 mm, at least about 6 mm, or at least about 10 mm; and/or less than about 200 mm, less than about 75 mm, or less than about 30 mm, although greater and lesser thicknesses may also be useful.

Further details concerning nonwoven abrasive articles, abrasive wheels and methods for their manufacture may be found, for example, in U.S. Pat. No. 2,958,593 (Hoover et al.); U.S. Pat. No. 5,591,239 (Larson et al.); U.S. Pat. No. 6,017,831 (Beardsley et al.); and U.S. Pat. Appln. Publ. 2006/0041065 A 1 (Barber, Jr.).

Frequently, it is useful to apply a prebond resin to the nonwoven web before coating with the binder precursor. The prebond resin serves, for example, to help maintain the nonwoven web integrity during handling, and may also facilitate bonding of the binder to the nonwoven web. Examples of prebond resins include phenolic resins, urethane resins, hide glue, acrylic resins, urea-formaldehyde resins, melamine-formaldehyde resins, epoxy resins, and combinations thereof. The amount of prebond resin used in this manner is typically adjusted toward the minimum amount consistent with bonding the fibers together at their points of crossing contact. If the nonwoven web includes thermally bondable fibers, thermal bonding of the nonwoven web may also be helpful to maintain web integrity during processing.

Abrasive articles according to the present disclosure may be converted, for example, into a belt, tape roll, disc, or sheet. They may be used by hand or in combination with a machine such as a belt grinder. For belt applications, the two free ends of an abrasive sheet are joined together and spliced, thus forming an endless belt. A spliceless belt, for example, as described in WO 93/12911, can also be used. Generally, an endless abrasive belt can traverse over at least one idler roll and a platen or contact wheel. The hardness of the platen or contact wheel is adjusted to obtain the desired rate of cut and workpiece surface finish. The abrasive belt speed depends upon the desired cut rate and surface finish and generally ranges anywhere from about 20 to 100 surface meters per second, typically between 30 to 70 surface meter per second. The belt dimensions can range from about 0.5 cm to 100 cm wide or 1.0 cm to 30 cm wide, and from about 5 cm to 1,000 cm long or from 50 cm to 500 cm long. Abrasive tapes are continuous lengths of the abrasive article and can range in width from about 1 mm to 1,000 mm or from about 5 mm to 250 mm. The abrasive tapes are usually unwound, traversed over a support pad that forces the tape against the workpiece, and then rewound. The abrasive tapes can be continuously fed through the abrading interface and can be indexed. Abrasive discs, which may also include that which is in the shape known in the abrasive art as "daisy", can range from about 50 mm to 1,000 mm in diameter or about 50 mm to about 100 mm in diameter. Typically, abrasive discs are secured to a back-up pad by an attachment means and can rotate between 100 to 20,000 revolutions per minute, typically between 1,000 to 15,000 revolutions per minute.

The abrasive article can be used to abrade a workpiece. The workpiece can be any type of material such as metal, metal alloys, exotic Is metal alloys, ceramics, glass, wood, wood like materials, composites, painted surface, plastics, reinforced plastic, stones, and combinations thereof. The workpiece may be flat or may have a shape or contour associated with it. Examples of workpieces include glass eye glasses, plastic eye glasses, plastic lenses, glass television screens, metal automotive components (e.g., clutch plates and other flat automotive components), stainless steel coils, plastic components, particle board, painted automotive components, magnetic media, tubing, plates, hydraulic rods, and elevator shafts.

During abrading, the abrasive article and the workpiece are moved relative to each other such that the abrasive article abrades the workpiece. The abrasive article is moved relative to the workpiece, or vice versa. Depending upon the application, the force at the abrading interface can range from about 0.1 kg to over 1000 kg. Typically, this range is between 1 kg to 500 kg of force at the abrading interface. In addition, abrading may occur under wet conditions. Wet conditions can include water and/or a liquid organic compound. Examples of typical liquid organic compounds include lubricants, oils, emulsified organic compounds, cutting fluids, and soaps. These liquids may also contain other additives such as defoamers, degreasers, and corrosion inhibitors. The abrasive article may oscillate at the abrading interface during use, which may result in a finer surface on the workpiece being abraded.

The method according to the present disclosure is useful for abrading workpieces having a Rockwell C hardness of less than about 20. Examples of materials having Rockwell C hardness values of less than about 20 include stainless steel, carbon steel, and titanium. The hardness measurements can be made according to ASTM Standard Number A370-90.

Some Embodiments of the Disclosure

In a first embodiment, the present disclosure provides an abrasive agglomerate particle comprising fused aluminum oxide mineral bonded in a vitreous matrix, wherein the fused aluminum oxide mineral is present in a range from 70 percent by weight to 95 percent by weight and the vitreous matrix is present at least at five percent by weight, based on the weight of the abrasive agglomerate particle, wherein the fused aluminum oxide mineral has an average particle size of up to 300 micrometers, and wherein the abrasive agglomerate particle has a frusto-pyramidal shape with side walls having a taper angle in a range from 2 to 15 degrees and a dimension of at least 400 micrometers.

In a second embodiment, the present disclosure provides the abrasive agglomerate particle of the first embodiment, wherein the abrasive agglomerate particle has a maximum face dimension of less than 1.5 millimeters.

In a third embodiment, the present disclosure provides the abrasive agglomerate particle of the first or second embodiment, wherein the fused aluminum oxide mineral has an average particle size of at least 10 micrometers.

In a fourth embodiment, the present disclosure provides the abrasive agglomerate particle of any one of the first to third embodiments, wherein the abrasive agglomerate particle has engineered porosity.

In a fifth embodiment, the present disclosure provides the abrasive agglomerate particle of any one of the first to third embodiments, wherein the vitreous matrix has a coefficient of thermal expansion in a range from $4\times10^{-6}$/K to $16\times10^{-6}$/K.

In a sixth embodiment, the present disclosure provides the abrasive agglomerate particle of any one of the first to fifth embodiments, wherein the fused aluminum oxide mineral is present in a range from 70 percent by weight to 85 percent by weight and the vitreous matrix is present at least at 15 percent by weight, based on the weight of the abrasive agglomerate particle.

In a seventh embodiment, the present disclosure provides the abrasive agglomerate particle of any one of the first to sixth embodiments, wherein the fused aluminum oxide mineral has an average particle size of up to 200 micrometers.

In an eighth embodiment, the present disclosure provides the abrasive agglomerate particle of any one of the first to seventh embodiments, wherein the abrasive agglomerate particle has a dimension of at least 500 micrometers.

In a ninth embodiment, the present disclosure provides an abrasive article comprising a plurality of the abrasive agglomerate particles of any one of the first to eighth embodiments.

In a tenth embodiment, the present disclosure provides the abrasive article of the ninth embodiment, wherein the abrasive article is a coated abrasive article.

In an eleventh embodiment, the present disclosure provides the abrasive article of the tenth embodiment, wherein the coated abrasive article comprises a backing and the plurality of abrasive agglomerate particles attached to the backing with a polymeric binder.

In a twelfth embodiment, the present disclosure provides the abrasive article of the eleventh embodiment, wherein the polymeric binder comprises a phenolic binder.

In a thirteenth embodiment, the present disclosure provides the abrasive article of the eleventh or twelfth embodiment, wherein the polymeric binder has a Knoop hardness of less than 60.

In a fourteenth embodiment, the present disclosure provides the abrasive article of the ninth embodiment, wherein the abrasive article is a nonwoven abrasive article.

In a fifteenth embodiment, the present disclosure provides the abrasive article of the fourteenth embodiment, wherein the nonwoven abrasive comprises a polymeric binder.

In a sixteenth embodiment, the present disclosure provides the abrasive article of the fifteenth embodiment, wherein the polymeric binder comprises a phenolic binder.

In a seventeenth embodiment, the present disclosure provides the abrasive article of the fifteenth or sixteenth embodiment, wherein the polymeric binder has a Knoop hardness of less than 60.

In an eighteenth embodiment, the present disclosure provides a method of abrading a workpiece, the method comprising:

contacting the workpiece with the abrasive article of any one of the ninth to seventeenth embodiments, and moving the workpiece and the abrasive article relative to each other to abrade the workpiece.

In a nineteenth embodiment, the present disclosure provides the method of the eighteenth embodiment, wherein the workpiece has a Rockwell C hardness of 20 or less.

In a twentieth embodiment, the present disclosure provides the method of the eighteenth or nineteenth embodiment, wherein the workpiece comprises at least one of stainless steel, carbon steel, or titanium.

In a twenty-first embodiment, the present disclosure provides a method of abrading a workpiece, the method comprising:

contacting the workpiece with an abrasive article, wherein the workpiece has a Rockwell C hardness of 20 or less, and moving the workpiece and the abrasive article relative to each other to abrade the workpiece, wherein the abrasive article comprises a backing and a plurality of shaped abrasive agglomerate particles attached to the backing with a polymeric binder having a Knoop hardness of less than 60, and wherein the shaped abrasive agglomerate particles comprise abrasive particles having a Knoop hardness of up to 3000 bonded in a vitreous matrix.

In a twenty-second embodiment, the present disclosure provides the method of the twenty-first embodiment, wherein the workpiece comprises at least one of stainless steel, carbon steel, or titanium.

In a twenty-third embodiment, the present disclosure provides the method of the twenty-first or twenty-second embodiment, wherein the abrasive particles comprise fused aluminum oxide particles.

In a twenty-fourth embodiment, the present disclosure provides the method of the twenty-third embodiment, wherein the fused aluminum oxide particles have an average particle size of up to 300 micrometers.

In a twenty-fifth embodiment, the present disclosure provides the method of the twenty-third or twenty-fourth embodiment, wherein the fused aluminum oxide mineral has an average particle size of at least 15 micrometers.

In a twenty-sixth embodiment, the present disclosure provides the method of any one of the twenty-first to twenty-fifth embodiments, wherein the abrasive particles are present in a range from 70 percent by weight to 95 percent by weight and the vitreous matrix is present at least at five percent by weight, based on the total weight of the shaped abrasive agglomerate particles.

In a twenty-seventh embodiment, the present disclosure provides the method of any one of the twenty-first to twenty-sixth embodiments, wherein the abrasive particles are present in a range from 70 percent by weight to 85 percent by weight and the vitreous matrix is present at least at 15 percent by weight, based on the total weight of the shaped abrasive agglomerate particles.

In a twenty-eighth embodiment, the present disclosure provides the method of any one of the twenty-first to the twenty-seventh embodiments, wherein the shaped abrasive agglomerate particle has engineered porosity.

In a twenty-ninth embodiment, the present disclosure provides the method of any one of the twenty-first to the twenty-seventh embodiments, wherein the vitreous matrix has a coefficient of thermal expansion in a range from $4\times10^{-6}$/K to $16\times10^{-6}$/K.

In a thirtieth embodiment, the present disclosure provides the method of any one of the twenty-first to twenty-ninth embodiments, wherein the shaped abrasive agglomerate particle has a frusto-pyramidal shape.

In a thirty-first embodiment, the present disclosure provides the method of the thirtieth embodiment, wherein the shaped abrasive agglomerate particles have side walls having a taper angle in a range from 2 to 15 degrees.

In a thirty-second embodiment, the present disclosure the method of any one of the twenty-first to thirty-first embodiments, wherein the shaped abrasive agglomerate particles have a dimension of at least 400 micrometers.

In a thirty-third embodiment, the present disclosure provides the method of any one of the twenty-first to thirty-second embodiments, wherein the shaped abrasive agglomerate particles have a dimension of at least 500 micrometers.

In a thirty-fourth embodiment, the present disclosure provides the method of any one of the twenty-first to thirty-second embodiments, wherein the abrasive agglomerate particle has a maximum dimension of less than 1.5 millimeters.

In a thirty-fifth embodiment, the present disclosure provides the method of any one of the twenty-first to thirty-fourth embodiments, wherein the abrasive article is a coated abrasive.

In a thirty-sixth embodiment, the present disclosure provides the method of any one of the twenty-first to thirty-fourth embodiments, wherein the abrasive article is a non-woven abrasive.

In a thirty-seventh embodiment, the present disclosure provides the method of any one of the twenty-first to thirty-sixth embodiments, wherein the polymeric binder is a phenolic binder.

In a thirty-eighth embodiment, the present disclosure provides the method of any one of the twenty-first to thirty-seventh embodiments, wherein the abrasive article is a belt, tape roll, disc, or sheet.

In a thirty-ninth embodiment, the present disclosure provides the method of any one of the twenty-first to thirty-seventh embodiments, wherein the workpiece comprises at least a portion of an elevator shaft.

In order that the present disclosure can be more fully understood, the following examples are set forth. It should be understood that these examples are for illustrative purposes only, and are not to be construed as limiting this disclosure in any manner. For example, the particular materials and amounts thereof recited in these examples, as well as other conditions and details, should not be construed to unduly limit this disclosure.

EXAMPLES

Unless otherwise noted, all parts, percentages, ratios, etc. in the Examples and the rest of the specification are by weight. Unless stated otherwise, all other reagents were obtained, or are available from fine chemical vendors such as Sigma-Aldrich Company, St. Louis, Mo., or may be synthesized by known methods. In the Examples, the following unit abbreviations are used: ° C. for degrees Centigrade, cm for centimeter, g/m$^2$ for grams per square meter, and mm for millimeter.

Materials used in the Examples are described in Table 1, below.

TABLE 1

| ABBREVIATION | DESCRIPTION |
|---|---|
| AER | Wetting agent, obtained under the trade designation "AEROSOL AY-100" from Cytec Industries, Inc., Woodland Park, New Jersey |
| AF | Antifoam additive, obtained under the trade designation "62 ADDITIVE" from Dow Corning, Midland, Michigan |
| DEX | Dextrin, obtained under the trade designation "STADEX 201" from Tate & Lyle, London, United Kingdom |
| MCL | Methylcellulose, obtained under the trade designation "METHOCEL K4M" from Dow Chemical Company, Midland, Michigan |
| P180 | Alumina abrasive particle conforming the FEPA (Federation of the European Producers of Abrasives) standard for P180, obtained under trade designation "ALODUR BFRPL" from Treibacher Schleifmittel GmbH, Villach, Austria |
| P240 | Alumina abrasive particle conforming the FEPA standard for P240, obtained under the trade designation "DURALUM G52" from Washington Mills Electro Minerals Company, Niagara Falls, New York |
| P320 | Alumina abrasive particle conforming the FEPA standard for P320, obtained under the trade designation "DURALUM G52" from Washington Mills Electro Minerals Company |
| P400 | Alumina abrasive particle conforming the FEPA standard for P400, obtained under the trade designation "DURALUM G52" from Washington Mills Electro Minerals Company |
| P600 | Alumina abrasive particle conforming the FEPA standard for P600, obtained under the trade designation "DURALUM G52" from Washington Mills Electro Minerals Company |
| SIL | Hydrophilic fumed silica, obtained under trade designation "AEROSIL OX-50" from Evonik Industries, Essen, Germany |
| V601 | A glass frit blend |

Preparation of Agglomerates

For agglomerates used in each of Examples 1 through 5, a slurry was prepared by mixing the components listed in Table 2. The components were mixed using a high-shear mixer. The resultant slurry was coated into a polypropylene mold with cavities having square openings approximately 0.87 mm long and wide and square bases approximately 0.65 mm long and wide; the depth of these cavities (H in FIG. 1) was 0.77 mm. The taper angle of the mold was 8 degrees. The slurry was dried in an oven at 110° C. for 20 minutes to form shaped agglomerates.

TABLE 2

| | Component/Weight Percentage | | | | |
|---|---|---|---|---|---|
| | Agglomerate 1 | Agglomerate 2 | Agglomerate 3 | Agglomerate 4 | Agglomerate 5 |
| AER | 1.46% | 1.47% | 1.49% | 1.51% | 1.54% |
| AF | 0.49% | 0.49% | 0.50% | 0.50% | 0.51% |
| DEX | 1.95% | 1.96% | 1.98% | 2.01% | 2.06% |
| MCL | 0.49% | 0.49% | 0.50% | 0.50% | 0.51% |
| SIL | 1.52% | 1.54% | 1.55% | 1.57% | 1.61% |
| V601 | 16.25% | 15.76% | 15.18% | 14.52% | 13.21% |
| P180 | 0 | 0 | 0 | 0 | 51.41% |
| P240 | 0 | 0 | 0 | 50.24% | 0 |
| P320 | 0 | 0 | 49.62% | 0 | 0 |
| P400 | 0 | 49.08% | 0 | 0 | 0 |
| P600 | 48.65% | 0 | 0 | 0 | 0 |
| Water | 29.19% | 29.21% | 29.18% | 29.14% | 29.15% |

The dried shaped agglomerates were released from the tooling using an ultrasonic horn, and subsequently mixed with fine grade alumina powder (obtained under trade designation "P172" from Alteo Alumina, Gardanne, France), before being fired at higher temperatures (the conditions were programmed as in Table 3) in a refractory sager in a box kiln.

TABLE 3

| Segment | Heating Ramp (° C./minute) | Temperature (° C.) | Dwell (hour) |
|---|---|---|---|
| 1 | 2.0 | 420 | 2 |
| 2 | 2.0 | 700 | 0.5 |
| 3 | 3.0 | 880 | 4 |

After firing, the refractory sager were allowed to cool naturally to near room temperature. The resulting fired agglomerates comprised components listed in Table 4. The agglomerates were then screened using U.S.A. Standard Test Sieves −18+25.

TABLE 4

| | Component/Weight Percentage | | | | |
|---|---|---|---|---|---|
| | Agglomerate 1 | Agglomerate 2 | Agglomerate 3 | Agglomerate 4 | Agglomerate 5 |
| SIL | 2.29% | 2.31% | 2.34% | 2.37% | 2.43% |
| V601 | 24.46% | 23.74% | 22.88% | 21.89% | 19.95% |
| P180 | 0 | 0 | 0 | 0 | 77.62% |
| P240 | 0 | 0 | 0 | 75.74% | 0 |
| P320 | 0 | 0 | 74.78% | 0 | 0 |
| P400 | 0 | 73.95% | 0 | 0 | 0 |
| P600 | 73.24% | 0 | 0 | 0 | 0 |

Example 1

The cloth backing, obtained as "ERATEX QUALITY N859 P39 YB1700" from Gustav Ernstmeier GmbH & Co. KG, Herford, Germany, was coated with 272.0 g/m$^2$ of a phenolic make resin consisting of 52 parts of resole phenolic resin (obtained under trade designation "GP 8339 R-23155B" from Georgia Pacific Chemicals, Atlanta, Ga.), 45 parts of calcium metasilicate (obtained under trade designation "WOLLASTOCOAT" from NYCO Company, Willsboro, N.Y.), and 2.5 parts of water using a knife to fill the backing weave and remove excess resin.

Agglomerates 1 were applied to the make resin-coated backing by drop coating. The coating weight of agglomerate 1 was 606.8 g/m$^2$ over the sample. The abrasive coated backing was placed in an oven at 65.5° C. for 15 minutes and then at 98.9° C. for 65 minutes to partially cure the make resin. A size resin consisting of 45.76 parts of resole phenolic resin (obtained under trade designation "GP 8339 R-23155B" from Georgia Pacific Chemicals), 4.24 parts of water, 24.13 parts of cryolite (Solvay Fluorides, LLC, Houston, Tex.), 24.13 parts calcium metasilicate (obtained under trade designation "WOLLASTOCOAT" from NYCO Company) and 1.75 parts red iron oxide was applied to each strip of backing material at a basis weight of 661.2 g/m$^2$, and the coated strip was placed in an oven at 87.8° C. for 100 minutes, followed by 12 hours at 102.8° C. After cure, the strip of coated abrasive was converted into a belt as is known in the art.

The Knoop hardness of the make and size resin were measured to be 47 using a Tukon Hardness Tester, Model 200, available from Wilson Instruments of Binghampton, N.Y. The indentation hardness determination of organic/polymeric coatings is described in ASTM D 1474-85 (Method A). Coatings of approximately 15 mils were applied to glass microscope slide. Subsequently, the coatings were dried and cured with heat. The method consisted of applying a 100 gram load to the surface of a coating by means of a pyramidal shaped diamond having specified face angles and converting the length measurement of the resulting permanent indentation to the Knoop Hardness Number.

Examples 2 to 5

The procedure generally described in Example 1 was repeated for each of Examples 2 through 5, with the exception that agglomerates, coating weights of agglomerates, make resin and size resin listed in Table 5 were used.

TABLE 5

| Mineral | Example 2 Agglomerate 2 | Example 3 Agglomerate 3 | Example 4 Agglomerate 4 | Example 5 Agglomerate 5 |
|---|---|---|---|---|
| Agglomerate Coating Weight | 619.4 g/m$^2$ | 619.4 g/m$^2$ | 631.9 g/m$^2$ | 627.7 g/m$^2$ |
| Make Coat Add-on | 272.0 g/m$^2$ | 272.0 g/m$^2$ | 276.2 g/m$^2$ | 267.8 g/m$^2$ |
| Size Coat Add-on | 657.0 g/m$^2$ | 590.1 g/m$^2$ | 631.9 g/m$^2$ | 640.3 g/m$^2$ |

Comparative A

Coated abrasive belt obtained under trade designation "KK718X" Grit P600 from VSM Abrasives Corporation, O'Fallon Mo.

Comparative B

Coated abrasive belt obtained under trade designation "KK718X" Grit P400 from VSM Abrasives Corporation.

Comparative C

Coated abrasive belt obtained under trade designation "KK718X" Grit P320 from VSM Abrasives Corporation.

Comparative D

Coated abrasive belt obtained under trade designation "KK718X" Grit P240 from VSM Abrasives Corporation.

Comparative E

Coated abrasive belt obtained under trade designation "KK718X" Grit P180 from VSM Abrasives Corporation.

Comparative F

Coated abrasive belt obtained under trade designation "359F" Grit P400 from 3M Company, Saint Paul, Minn.

Comparative G

Coated abrasive belt obtained under trade designation "359F" Grit P320 from 3M Company.

Comparative H

Coated abrasive belt obtained under trade designation "359F" Grit P180 from 3M Company.

Performance Evaluation

A 2 inch (5.08 cm) diameter coated abrasive disc was made from each of Examples 1 through 5 and Comparatives A through H by die-cutting final cured belt. A ROLOC (type TR) quick change attachment (described in the disclosure of U.S. Pat. No. 6,817,935) was affixed to the center back of the disc using adhesive (obtained under trade designation "LOCTITE 406" from Henkel Corporation, Westlake, Ohio). The disc to be tested was mounted on an electric rotary tool that was disposed over an X-Y table having a 1018 steel bar measuring 2 inches×18 inches×0.5 inch (50.8 mm×457.2 mm×12.7 mm) secured to the X-Y table. The tool was set to traverse at a rate of 6 inches/second (152.4 mm/sec) in the X direction along the length of the bar. The rotary tool was then activated to rotate at 7500 rounds per minute under no load. A stream of tap water was directed onto the bar on the surface to be ground, under the disc. The abrasive article was then urged at an angle of 5 degrees against the bar at a load of 9 pounds (4.08 kilograms). The tool was then activated to move along the length of the bar. The tool was then raised, and returned to the opposite end of the bar. Ten such grinding-and-return passes along the length of the bar were completed in each cycle for a total of 6 cycles. The mass of the bar was measured before and after each cycle to determine the total mass loss in grams after each cycle. A cumulative mass loss was determined at the end of 6 cycles. The disc was weighed before and after the completion of the test (6 cycles) to determine the wear. The test result for each example is shown in Table 6.

TABLE 6

| | Cut Per Cycle (grams) | | | | | | Total Cut | Wear |
|---|---|---|---|---|---|---|---|---|
| | Cycle 1 | Cycle 2 | Cycle 3 | Cycle 4 | Cycle 5 | Cycle 6 | (grams) | (grams) |
| Example 1 | 0.72 | 0.69 | 0.66 | 0.63 | 0.64 | 0.60 | 3.92 | 0.43 |
| Comparative A | 0.46 | 0.20 | 0.02 | | | | 0.68 | 0.28 |
| Example 2 | 1.20 | 1.14 | 1.05 | 1.03 | 0.99 | 0.97 | 6.36 | 0.74 |
| Comparative B | 0.85 | 0.65 | 0.38 | 0.29 | 0.11 | 0.11 | 2.39 | 1.17 |
| Comparative F | 1.19 | 1.21 | 1.05 | 0.59 | 0.34 | 0.25 | 4.63 | 2.80 |
| Example 3 | 1.21 | 1.15 | 1.16 | 1.19 | 1.16 | 1.15 | 7.01 | 0.84 |
| Comparative C | 1.01 | 0.80 | 0.59 | 0.49 | 0.27 | 0.23 | 3.39 | 1.74 |
| Comparative G | 1.33 | 1.29 | 1.20 | 1.03 | 0.56 | 0.37 | 5.78 | 3.17 |
| Example 4 | 1.87 | 1.77 | 1.70 | 1.70 | 1.64 | 1.58 | 10.25 | 1.36 |
| Comparative D | 1.69 | 1.47 | 1.04 | 0.57 | 0.26 | 0.19 | 5.22 | 1.96 |
| Example 5 | 2.08 | 1.98 | 1.92 | 1.84 | 1.85 | 1.85 | 11.52 | 0.88 |
| Comparative E | 2.78 | 2.25 | 1.10 | 0.47 | 0.27 | 0.20 | 7.07 | 2.20 |
| Comparative H | 2.09 | 1.74 | 1.80 | 1.60 | 1.14 | 0.45 | 8.82 | 2.99 |

This disclosure is not limited to the above-described embodiments but is to be controlled by the limitations set forth in the following claims and any equivalents thereof. This disclosure may be suitably practiced in the absence of any element not specifically disclosed herein.

What is claimed is:

1. An abrasive article comprising a backing and a plurality of abrasive agglomerate particles attached to the backing with a polymeric binder having a Knoop hardness of 47 or less, wherein the abrasive agglomerate particles comprise fused aluminum oxide mineral bonded in a vitreous matrix, wherein the fused aluminum oxide mineral is present in a range from 70 percent by weight to 95 percent by weight and the vitreous matrix is present at least at five percent by weight, based on the weight of the abrasive agglomerate particles, wherein the fused aluminum oxide mineral has an average particle size of up to 300 micrometers, and wherein the abrasive agglomerate particles have a frusto-pyramidal shape with side walls having a taper angle in a range from 2 to 15 degrees and a dimension of at least 400 micrometers.

2. The abrasive particle of claim 1, wherein the abrasive agglomerate particles have a maximum dimension of less than 1.5 millimeters.

3. The abrasive particle of claim 1, wherein the fused aluminum oxide mineral has an average particle size of at least 10 micrometers.

4. The abrasive particle of claim 1, wherein the fused aluminum oxide mineral has an average particle size of up to 200 micrometers.

5. The abrasive particle of claim 1, wherein the abrasive agglomerate particles have engineered porosity.

6. The abrasive article of claim 1, wherein the polymeric binder comprises a phenolic binder.

7. The abrasive article of claim 1, wherein the abrasive article is a nonwoven abrasive article.

8. A method of abrading a workpiece, the method comprising:

contacting the workpiece with the abrasive article of claim 1, and moving the workpiece and the abrasive article relative to each other to abrade the workpiece.

9. The method of claim 8, wherein the workpiece has a Rockwell C hardness of 20 or less.

10. The method of claim 8, wherein the workpiece comprises at least one of stainless steel, carbon steel, or titanium.

11. The abrasive article of claim 7, wherein the nonwoven abrasive article comprises a phenolic binder.

12. The abrasive particle of claim 1, wherein the abrasive agglomerate particles have a dimension of at least 500 micrometers.

13. The abrasive particle of claim 1, wherein the fused aluminum oxide mineral is present in a range from 70 percent by weight to 85 percent by weight and the vitreous matrix is present at least at 15 percent by weight, based on the weight of the abrasive particles.

14. The abrasive article of claim 1, wherein the vitreous matrix has a coefficient of thermal expansion in a range from $4\times10^{-6}$/K to $16\times10^{-6}$/K.

15. The method of claim 8, wherein the abrasive agglomerate particles have a maximum dimension of less than 1.5 millimeters.

16. The method of claim 8, wherein the fused aluminum oxide mineral has an average particle size of at least 10 micrometers.

17. The method of claim 8, wherein the fused aluminum oxide mineral has an average particle size of up to 200 micrometers.

18. The method of claim 8, wherein the abrasive agglomerate particles have engineered porosity.

19. The method of claim 8, wherein the polymeric binder comprises a phenolic binder.

20. The method of claim 8, wherein the fused aluminum oxide mineral is present in a range from 70 percent by weight to 85 percent by weight and the vitreous matrix is present at least at 15 percent by weight, based on the weight of the abrasive agglomerate particles.

* * * * *